United States Patent [19]

Hoover

[11] Patent Number: 4,805,700

[45] Date of Patent: Feb. 21, 1989

[54] FOAM GENERATOR ADJUSTABLE TO PRODUCE FOAM HAVING VARIOUS EXPANSION RATIOS

[75] Inventor: Stanley M. Hoover, Gibsonia, Pa.

[73] Assignee: Mine Safety Appliances Company, Pittsburgh, Pa.

[21] Appl. No.: 55,604

[22] Filed: May 29, 1987

[51] Int. Cl.[4] ..... A62C 5/04

[52] U.S. Cl. ..... 169/15; 169/14; 239/569; 239/343; 239/581.1

[58] Field of Search ..... 169/14, 15, 44, 70; 239/432, 343, 370, DIG. 23, 581.1, 582.2, 569

[56] References Cited

U.S. PATENT DOCUMENTS

| | | | |
|---|---|---|---|
| 3,446,285 | 5/1969 | Hout | 169/15 |
| 4,420,047 | 12/1983 | Bruensicke | 169/53 |

FOREIGN PATENT DOCUMENTS

| | | | |
|---|---|---|---|
| 578071 | 10/1977 | U.S.S.R. | 169/15 |
| 709098 | 1/1980 | U.S.S.R. | 169/14 |
| 825110 | 4/1981 | U.S.S.R. | 239/569 |
| 1205919 | 1/1986 | U.S.S.R. | 169/15 |
| 29478 | of 1905 | United Kingdom | 239/569 |

*Primary Examiner*—Sherman D. Basinger
*Assistant Examiner*—Paul E. Salmon
*Attorney, Agent, or Firm*—Douglas K. McClaine

[57] ABSTRACT

A foamaking generator for use on fires and hazardous material spill control, having a nozzle that may be adjusted to direct a foam concentrate stream to cover variable amounts of area of a screen so that low, medium and high expansion ratio foams can be produced using one foam generator.

4 Claims, 2 Drawing Sheets

FOAM GENERATOR ADJUSTABLE TO PRODUCE FOAM HAVING VARIOUS EXPANSION RATIOS

FIELD OF THE INVENTION

This invention relates to the field of foam generating and spraying equipment for use in fire fighting and hazardous material spill control.

BACKGROUND OF THE INVENTION

One method of fighting fires or controlling hazardous material (hazmat) spills is the process of spraying foam over the fire or spill. When fighting fires, foam sprayed over a fire cuts off the fire's oxygen supply thereby extinguishing the fire. In hazmat spill operations, foam is used to prevent toxic materials from contacting the atmosphere. By covering the material with foam, toxic fumes emitted from the material are prevented from entering the atmosphere. Similarly, the atmosphere does not contact the material and the oxygen source for any potential fire is eliminated.

In either application, emergency personnel (fire fighters) use a hand-held foamaker to spray foam onto either the fire or the spilled material. Fire fighters begin the operation by spraying foam to the target area from the greatest possible distance so as to pretect themselves from intense heat or exposure to toxic materials.

In order to reach the target from distances of 35 to 50 feet, the fire fighter must use a foam having a low expansion ratio (for example, 5–20 to 1), since foam having a high expansion ratio cannot be propelled over such a distance.

There are inherent disadvantages in the use of low expansion ratio foams. One disadvantage is that these foams do not cover as great a target area as do higher expansion ratio foams. Accordingly, it is necessary to use more foam concentrate and the application becomes costlier than when high expansion foams are applied.

After the first application of low expansion foam and control of the fire or spill is obtained, the fire fighters can move in closer to the target area to within a distance of 12 to 15 feet of the target. At this distance, the fire fighter can then use a foam having a higher expansion ratio (for example, 250–1000 to 1) to blanket the area. A foam having a higher expansion ratio covers more of the target area than the low expansion foam and provides a thicker insulation layer between the fire or spill and the atmosphere. Further, foams having high expansion ratios require less water and concentrate to cover the same area as the low expansion foam. Accordingly, high expansion foams are less costly to apply.

In hazmat spill control operations, the fire fighter must match the expansion ratio to the type of chemical spill. For example, the hazmat specialist would not use low expansion foam on a water reactive liquid at any time. Since the nature of the spill is usually unknown, the variable expansion ratio appliance concept permits the control of any type of hazmat spill using the same piece of equipment.

Hazmat material spills upon which low expansion foam would typically be used are flammable, water immiscible liquids. Medium expansion foams typically are used on flammable, water immiscible (polar) liquids, and high expansion foams are typically used on water reactive liquids and liquified gases.

In order for the fire fighter to apply a low expansion foam and then a high expansion foam, the fighter must use two different foam generating devices. Accordingly, it would be desirable to have one foam generating device that could produce foams having variable expansion ratios ranging from low to high. It is the intent of this invention to provide such an apparatus, whereby the expansion ratio of the foam can be varied by adjusting a nozzle in the foam generating apparatus.

A variable flow rate foam device is described in Williams, U.S. Pat. No. 4,497,442. The Williams device is complicated in design and operation and is used solely to vary the flow rate of foam that is discharged from the nozzle rather than the expansion ratio of the foam. The present invention provides a means to vary the expansion ratio of the foam while the Williams device is capable of only producing a foam having one expansion ratio. Additional foamaking devices that are capable of producing foam having only one expansion rate are disclosed in Silverman, U.S. Pat. No. 3,306,008 and Barnes, U.S. Pat. No. 3,482,638.

SUMMARY OF THE INVENTION

The present invention provides a foamaking apparatus that can produce foams having variable expansion ratios. Fire fighting foam is produced by spraying a foam concentrate-water solution onto a screen positioned at one end of a housing. As the concentrate is blown onto the screen, air is aspirated into the opposite end of the housing and expelled from the housing as it passes through the screen. As the air passes through the screen, the foam solution on the screen is turned into foam and the foam is propelled out of the housing and onto the target.

The expansion ratio of the foam is dependent on the area of the screen that is covered by the solution. When the area of the screen that is covered is increased, the expansion ratio of the foam is increased. Accordingly, as the covered area of the screen decreases, the expansion ratio of the foam decreases. The covered area of the screen, and hence the ratio of expansion of the foam can be varied by varying the angle of the foam concentrate spray as it leaves the nozzle and before it strikes the screen. By varying the angle of the spray, the spray can be directed to cover small, medium or large areas of the screen, depending on the desired expansion ratio of the foam.

DETAILED DESCRIPTION OF THE PREFERRED EMBODIMENT

Figure 1:
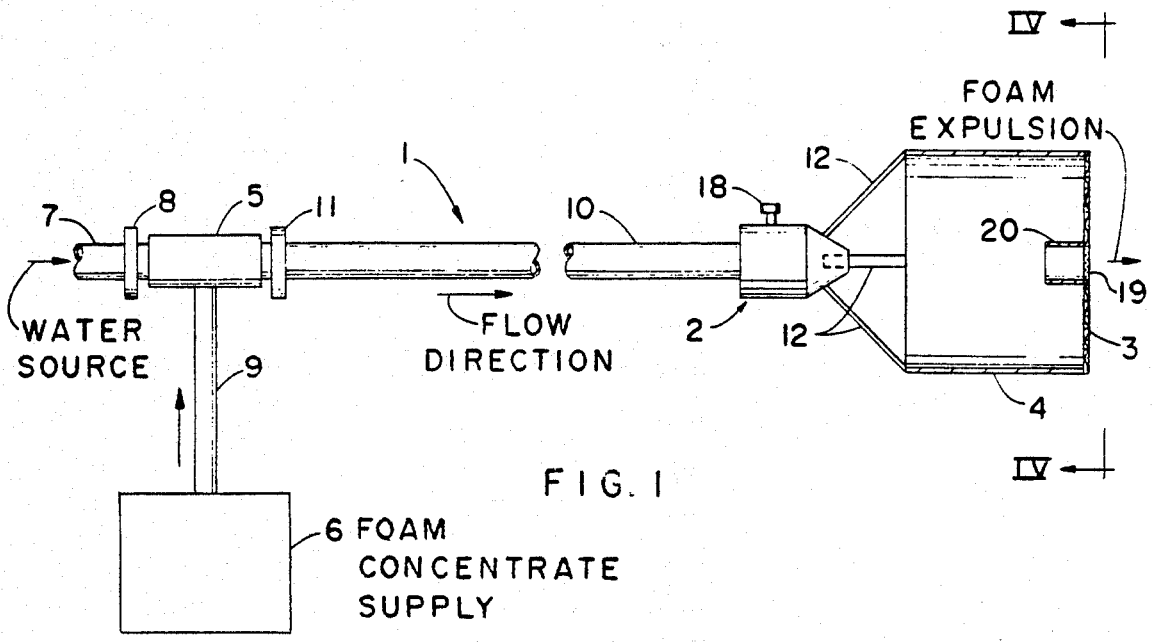
FIG. 1 is a side view schematic of the foamaking apparatus in partial sections.
Figure 4:
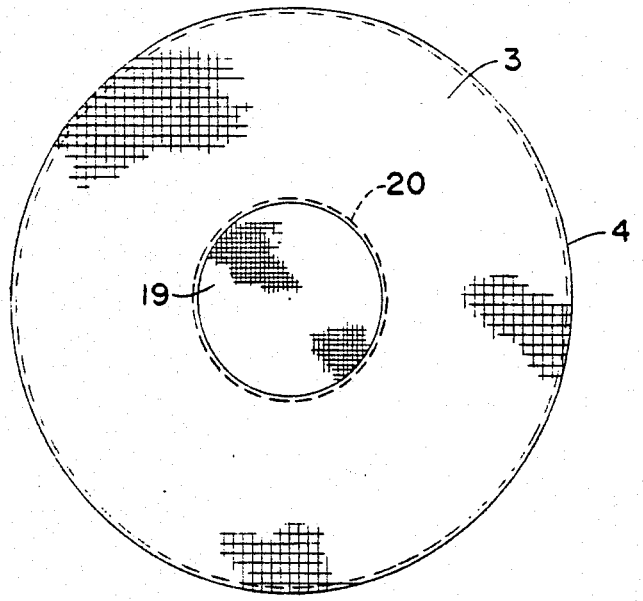
FIG. 4 is a frontal view of the foamaking apparatus housing.

With reference now to the drawings, FIGS. 1 and 4 show a side and front view of the complete foamaking apparatus 1. The apparatus 1 is comprised of a manually adjusted variable spray nozzle 2, a screen 3, a screen housing 4, an eductor 5, a foam concentrate supply 6, a water supply (not shown) and various hoses and couplings.

The water supply (not shown) is connected to a hose 7. The hose 7 is connected by means of a coupling 8 to one opening of an eductor 5. One end of a second hose 9 is connected to a second opening of the eductor 5. The other end of the second hose 9 is lowered into a supply of liquid foam concentrate 6. One end of a third hose 10, that may be up to 200 feet in length, is connected to an output opening of the eductor 5 by means of a second coupling 11. The other end of the third hose 10 is connected to the input opening of the variable spray nozzle 2. The nozzle 2 is attached to the screen housing 4 by attachment rods 12. The rods 12 are securely attached in such a manner to the outer surface of the nozzle 2, so as not to obstruct the output orifice 13 of the nozzle 2. The screen housing 4 is cylindrical in shape and has two openings. The output orifice 13 of the nozzle 2 is directed into one opening of the housing 4, while the other opening of the housing 4 is covered by a large screen 3 having screen mesh size of $0.00933/in^2$. Attached to the center of the screen 3 is a smaller cylinder 20 surrounding a smaller screen 19. Both the small cylinder 20 and small screen 19 have a preferred diameter of approximately 1.5 inches. The small screen 19 has openings in the screen mesh that are smaller in area than the mesh of the large screen 3. The open end of the small cylinder 20 is adapted to receive the foam solution jet that is expelled from the output orifice 13 when producing low expansion foam. The small cylinder 20 acts to direct the spray of the low expansion foam and prevent splattering of the solution onto the large screen 3.

When the water supply is turned on, water is forced through the first hose 7 and coupling 8 and through the eductor 5. As the water passes through the eductor 5, a venturi effect is created and a vacuum is formed inside of the eductor 5. This vacuum draws the foam concentrate 6 up the hose 9 and into the eductor 5. As the concentrate 6 is drawn into the eductor 5, the concentrate and water combine to form a foam solution. The foam solution is then forced out of the eductor 5 at a rate of approximately 22 gpm through the second coupling 11 into a third hose 10 and into the variable spray nozzle 2. The solution is then blown out of the nozzle 2 and onto the screen 3. As the solution passes into the open end of housing 4, air is aspirated into the housing through the open end of the housing 4. The aspirated air blows the foam solution through the screen 3 and out of the screen covered opening of the housing 4 thereby creating the foam that is blown over the fire or spill.

Figure 2:
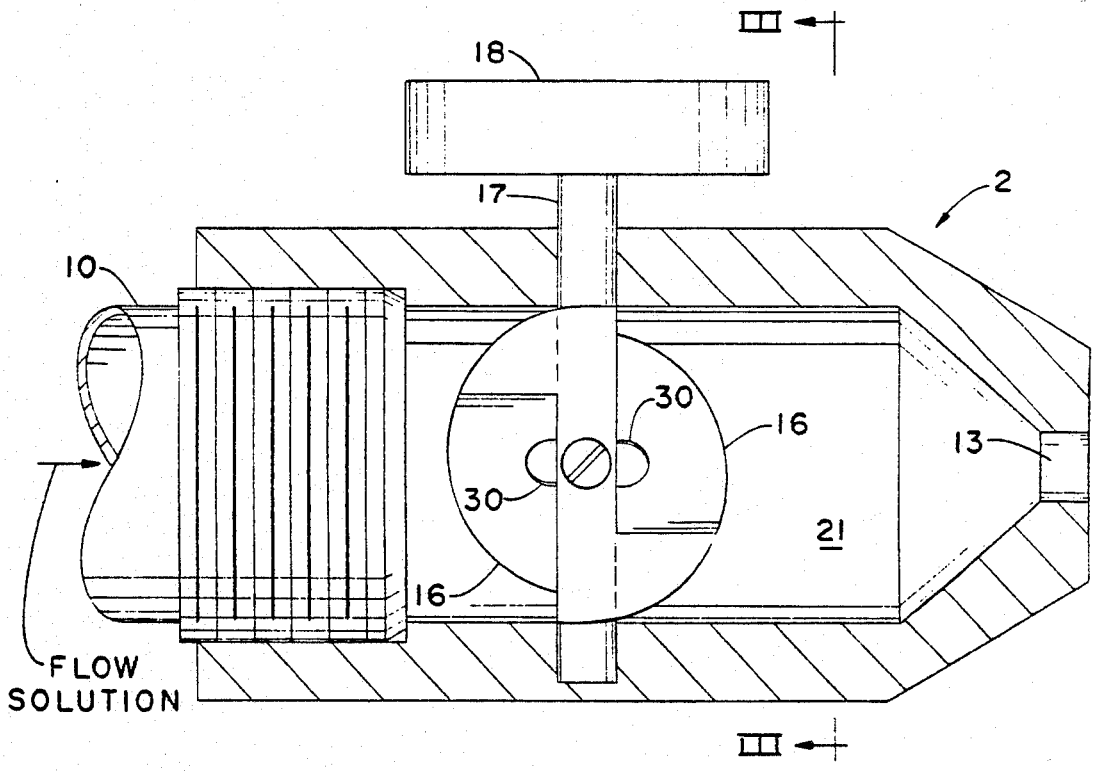
FIG. 2 is a cross sectional view of the variable angle spray nozzle.

Referring also now to FIG. 2, a cross sectional view of the variable angle spray nozzle 2 is shown. The hose 10 containing the solution, is connected to the input opening of the nozzle by screwing the nozzle 2 onto the hose 10 by means of threads formed in the nozzle 2 and hose 10. As the solution is forced into the nozzle 2, the solution is impinged upon fluid vanes 16.

It is desirable for the solution to enter the nozzle 2 with a preferred pressure of 80 psi, when making high expansion foam; 95 psi, when making medium expansion foam; and, 110 psi when making low expansion foam. The pressure of the solution can be determined by attached any type of commercially available pressure valve (not shown) in communication with the fluid stream at a position along the hose 10 between the coupling 11 and the nozzle 2.

The fluid vanes 16 are attached to a shaft 17 that runs through the internal chamber 21 of the nozzle 2. Affixed to one end of the shaft 17, outside of the nozzle 2, is a knob 18 that is used to rotate the shaft 17 and the fluid vanes 16 inside of the internal chamber 21 of the nozzle 2. The fluid vanes have small semi-circular notches 30 cut into the vane around the shaft 17. The notches 30 permit the solution to pass directly through the vanes when making high expansion foam. When the solution passes directly through the notches 30, the solution is projected from the nozzle 2 in a full cone spray pattern and the entire areas of the large screen 3 and small screen 19 are covered. Without the notches 30, the solution would be projected from the nozzle in a hollow cone pattern. In a hollow cone pattern, no solution is present in the center of the spray. Thus, no fluid can be directed straight out of the nozzle and onto the small screen 19. Thus, the entire output of the housing 4 is not covered and high expansion foam cannot be efficiently produced.

Figure 3A:
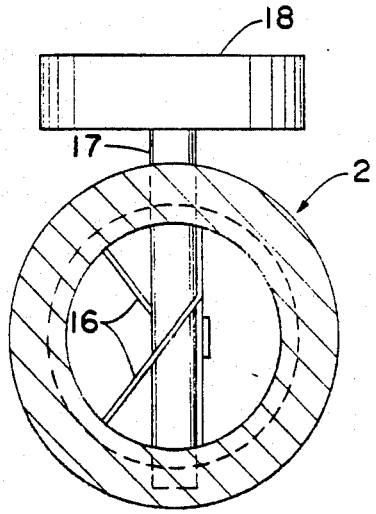
FIGS. 3(*a*), 3(*b*), and 3(*c*) are sectional views of the variable angle nozzle and fluid vanes looking into the output orifice of the nozzle, showing the orientation of the vanes when used to produce low, medium and high expansion ratio foams respectively.
Figure 3B:
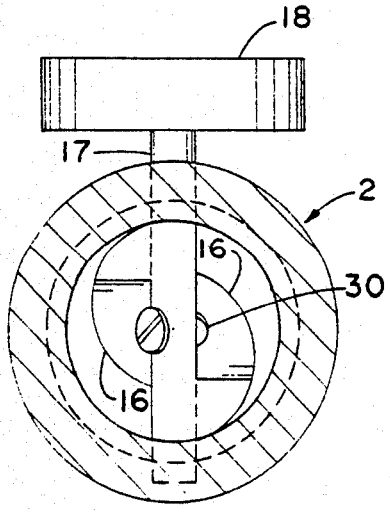
Figure 3C:
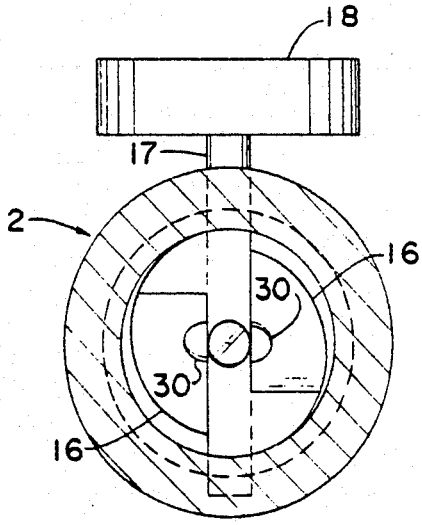

Referring now to FIG. 3, three orientations of the fluid vanes 16, as looking into the nozzle on cutting plane III—III are shown. FIG. 3(*a*) shows the orientation of the vanes 16 when used to produce low expansion foam. In this orientation, the solution stream passes directly through the nozzle 2 with negligible deflection caused by the vanes 16 or shaft 17. The solution then passes out of the nozzle orifice 13 into the small cylinder 20 and through the small screen 19. Because of the negligible deflection of the stream by the vanes 16, none of the large screen 3 is covered and low expansion foam can be projected to the target from a distance of up to fifty feet.

When the knob 18 is turned clockwise, approximately 45°, the orientation of the vanes 16 is as shown in FIG. 3(*b*). When the vanes are in this position, the solution is deflected somewhat by the vanes 16 as it passes through the nozzle 2. As a result of the deflection, the solution strikes both the small cylinder screen 19 and the large screen 3 thereby covering a greater area of the output opening of the housing 4. With this area of screen covered, the solution forms medium expansion foam that can strike a target nearly 35 feet from the foamaker. By turning the knob 18, again clockwise, approximately 45°, the orientation of the vanes is as shown in FIG. 3(*c*). In this orientation, the solution is deflected at its greatest angle from the centerline of the nozzle 2 to the housing screen 3. The solution now covers the small screen 19 as well as the large screen 3. With this area of screen covered, high expansion foam is produced that can strike a target at a distance of up to approximately 15 feet. Accordingly, by turning the knob 18 and thereby changing the orientation of the vanes 16 to the solution stream, the fire fighter can vary the expansion ratio of the generated foam while using the same apparatus.

Many additional modifications and variations of the present invention are possible in light of the above teachings. It is therefore to be understood that various changes and modifications may be made, all without departing from the spirit and scope of the invention as recited in the appended claims.

I claim:

1. A foamaking generator comprising:

a water supply source;

a hose adapted to receive said source at one end and fluidically connected to an output of an eductor;

a second hose adapted at one end to receive a foamaking concentrate solution and fluidically connected to a second input opening of said eductor;

a third hose, one end of which is fluidically connected to an output opening of said eductor, adapted to receive a water and foamaking concentrate mixture stream formed in said eductor and having a second end fluidically connected to a nozzle;

said nozzle having means to adjust the angle of projection of said mixture stream to cause said mixture stream to exit said nozzle in a full cone spray pattern;

a screen housing attached to said nozzle positioned to internally receive said mixture stream from one open end; and, a screen completely enclosing a second end of said housing.

2. A foamaking generator according to claim 1 having a cylinder of lesser diameter than said screen housing positioned parallel to and inside of said screen housing; said cylinder being affixed to said first screen and having one end adapted to receive said mixture stream that is propelled from said nozzle, where said cylinder's second open end is covered by a screen having smaller mesh size than the mesh size of said first screen.

3. A foamaking generator according to claim 1 in which said nozzle comprises:

a cylindrical housing having two open ends; where the second end opening is of smaller diameter than the first end opening and the first end opening is adapted to permit a fluidic connection between said nozzle and said fluid source;

a shaft extending from outside of said cylindrical housing and traversing the interior of the cylindrical housing and positioned so as to permit rotation of said shaft;

a turning means securely attached to the end of said shaft outside said cylindrical housing to facilitate rotation of said shaft; and, a fluid stream deflection means securely attached to said shaft inside the interior of said cylindrical housing, positioned to rotate said deflection means to deflect said stream of fluid thereby changing the angle of projection of said fluid as said fluid exits said cylindrical housing through said second end opening and having two semi-circular notches formed into said fluid deflection means around said shaft.

4. A fluid nozzle adapted to receive a fluid source comprising:

a cylindrical housing having two open ends; where the second end opening is of smaller diameter than the first end opening and the first end opening is adapted to permit a fluidic connection between said nozzle and said fluid source;

a shaft extending from outside of said cylindrical housing and traversing the interior of the cylindrical housing and positioned so as to permit rotation of said shaft;

a turning means securely attached to the end of said shaft outside said cylindrical housing to facilitate rotation of said shaft; and, a fluid stream deflection means securely attached to said shaft inside of said inner opening, positioned to rotate inside said inner opening to deflect said stream of fluid to change the angle of projection of said fluid as said fluid exits said cylindrical housing through said second end opening and having two semi-circular notches formed into said fluid deflection means around said shaft.

* * * * *